United States Patent [19]

Thebert

[11] Patent Number: 4,581,978

[45] Date of Patent: Apr. 15, 1986

[54] CONTROL SYSTEM FOR PRESSURE OPERATED ACTUATOR

[75] Inventor: Glenn W. Thebert, Carmel, Ind.

[73] Assignee: General Motors Corporation, Detroit, Mich.

[21] Appl. No.: 681,557

[22] Filed: Dec. 14, 1984

[51] Int. Cl.[4] ..... F15B 13/043

[52] U.S. Cl. ..... 91/448; 91/450; 91/461; 91/464; 137/312; 137/625.64

[58] Field of Search ..... 91/448, 450, 461, 464; 137/312, 625.64

[56] References Cited

U.S. PATENT DOCUMENTS 2,969,773 1/1961 Henry ..... 137/625.62 X
4,157,135 6/1979 Devlin et al. .

FOREIGN PATENT DOCUMENTS 1426471 11/1968 Fed. Rep. of Germany ..... 91/461

*Primary Examiner*—Gerald A. Michalsky
*Attorney, Agent, or Firm*—Saul Schwartz

[57] ABSTRACT

A control system for a fluid pressure operated actuator includes an arming valve having open and closed positions and a pilot operated selector valve having a neutral position and an extend position. The arming valve is connected to a source of fluid and the selector valve is connected to the arming valve so that two control inputs are necessary to connect the source to an operating chamber of the actuator. A solenoid actuated pilot valve is connected to the source and to a sump and has an on position in which the flow of fluid is unblocked and in an off position in which the flow of fluid is blocked. A pilot passage connects the pilot valve to a pilot chamber of the selector valve and a branch passage connects the pilot passage and the operating chamber of the actuator so that the operating chamber communicates with the sump whenever the pilot valve is off regardless of the position of the selector valve.

2 Claims, 1 Drawing Figure

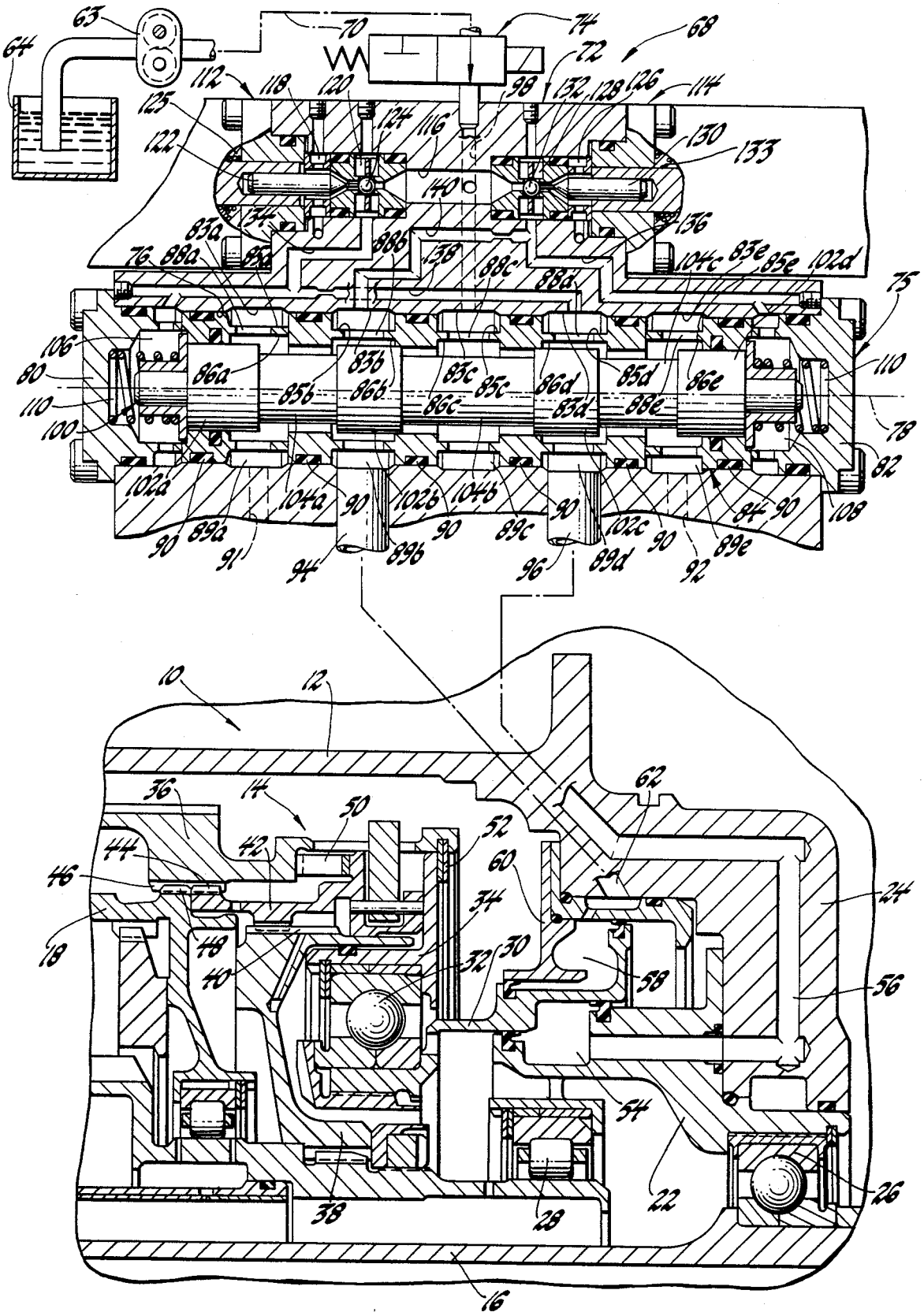
63
64
70
74
68
72
112
118
120
98
132
128
126
114
125
124
116
122
130
133
140
134
136
85a
88a
76
88b
138
88c
88d
104c
85e
85e
102d
75
106
80
110
86a
85b
86b
85c
86c
85c
86d
85d
86e
110
100
88e
78
82
102a
104a
90
102b
104b
90
84
90
108
90
89a
91
94
89b
90
89c
96
89d
102c
90
92
89e
10
12
36
14
50
62
44
42
52
46
60
24
18
48
34
40
32
30
58
56
54
22
26
38
28
16

CONTROL SYSTEM FOR PRESSURE OPERATED ACTUATOR

The invention herein described was made in the course of work under a contract or subcontract thereunder with the National Aeronautics and Space Administration.

BACKGROUND OF THE INVENTION

1. Field of the Invention

This invention relates generally to fluid pressure operated actuators and, more particularly, to a new and improved control system for such actuators.

2. Description of the Prior Art

Control systems for fluid pressure operated actuators typically include manual or pilot operated selector valves to control the flow of pressure fluid to actuator operating chambers. In some systems, an arming valve is disposed between the pressure fluid source and the selector valve so that two control inputs are required to effect actuator operation. Fluid leakage around the arming valve, however, represents a source of application pressure for the actuator in the event that the selector valve is stroked to a position corresponding to actuator operation. A control system, according to this invention, represents an improvement over heretofore known actuator control systems having series connected arming and selector valves in that it forecloses operation of the actuator induced by arming valve leakage fluid.

SUMMARY OF THE INVENTION

Accordingly, the primary feature of this invention is that it provides a new and improved control system for a fluid pressure operated actuator wherein separate control inputs to series connected arming and selector valves are required to operate the actuator. Another feature of this invention is that it provides a new and improved control system for a fluid pressure operated actuator wherein the control input to the selector valve is through a solenoid actuated pilot valve having an on position conducting pressure fluid to a pilot chamber of the selector valve and an off position exhausting the pilot chamber and the operating chamber of the actuator. Still another feature of this invention resides in the provision in the new and improved control system of a passage continuously interconnecting an operating chamber of the actuator and the pilot chamber of the selector valve so that whenever the pilot valve is in the off position the operating chamber of the actuator is exhausted and operation of the actuator is foreclosed regardless of the position of the selector valve. A still further and more specific feature of this invention resides in the provision in the new and improved control system of a selector valve having two operating positions alternately pressurizing two operating chambers of the actuator, two solenoid operated pilot valves each having on and off positions conducting pressure fluid to and exhausting corresponding ones of a pair of pilot chambers of the selector valve, and a pair of passages continuously interconnecting the operating chambers of the actuator and the corresponding pilot chambers so that when the pilot valves are in their off positions the operating chambers are exhausted regardless of the position of the selector valve.

These and other features of this invention will be readily apparent from the following specification and from the single drawing Figure depicting partially schematically and partially in cross section the control system according to this invention.

Referring now to the drawing, a partially illustrated shaft coupling 10 includes a stationary housing 12 within which is disposed a spline clutch 14 operative to directly couple a hollow cylindrical input shaft 16 to a drum 18 connected to an output shaft, not shown, disposed within the input shaft 16. The coupling 10 is disclosed in detail in my copending application Ser. No. 690,994 "Coupling with Spline Clutch", assigned to the assignee of this invention. A coupling essentially identical to coupling 10 is also disclosed in U.S. Pat. No. 4,157,135, issued June 5, 1979 to Devlin and Janeck and assigned to the assignee of this invention. In its relevant portions, the coupling 10 further includes an annular adaptor 22 rigidly attached to an end wall portion 24 of the housing and mounting a bearing 26, whereby a portion of the input shaft 16 is rotatably supported on the housing 12 and a bearing 28 whereby a shaft extension connected to the input shaft 16 is rotatably supported on the housing 12. An actuator in the form of an annular stepped piston 30 is supported on the adaptor 22 for longitudinal movement and carries at its inboard end for unitary longitudinal movement therewith a bearing 32. The outer race of the bearing 32 carries an annular bracket element 34 disposed within one end of a cylindrical intermediate lock member 36. An annular inner lock member 38, spline connected to the extension of input shaft 16, has a plurality of cicumferential splines 40 therearound between which are received corresponding internal splines of a generally cylindrical aft lock member 42. A plurality of external helical splines 44 on the aft lock member 42 continuously slidably engage a corresponding plurality of internal helical splines 46 on the intermediate lock member 36. Internal helical splines 46 selectively slidably engage a corresponding plurality of external helical splines 48 on the drum 18 connected to the output shaft. An annular wave spring 50 disposed between facing shoulders on the intermediate lock 36 and the aft lock member 42 urges relative separation therebetween. An annular retaining ring 52 prevents separation between the intermediate lock member 36 and the annular bracket element 34.

As described in the aforementioned patent application and U.S. patent to Devlin and Janneck, longitudinal movement of the stepped piston 30 to the left operates to shift the bearing 32 and bracket element 34 to the left, thereby exerting a force on the adjacent end of aft lock member 42 which, in turn, exerts a corresponding force on the intermediate lock member 36 through the spring 50. The intermediate lock member is thus shifted longitudinally from an unlocked position, not shown, wherein the helical splines 46 on the intermediate lock member are longitudinally separated from the external helical splines 48 on the drum 18 to a locked position, as shown, wherein the splines 46 and 48 are interengaged. The intermediate lock member 36 is longitudinally shifted to the unlocked position by longitudinal movement of the stepped piston 30 to the right. Movement of the piston 30 to the left is effected by introduction of pressurized hydraulic fluid to an annular chamber 54 defined between the piston 30 and the adaptor 22 through a passage 56 extending through the end wall portion 24 and the adaptor 22. Similarly, movement of the stepped piston 30 to the right is effected by introduction of pressurized hydraulic fluid to an annular chamber 58 defined between the piston 30 and another adaptor assembly 60 on the housing through a passage 62. A pump 63 draws fluid from a sump 64, increases the pressure of the fluid to about 250 psi, and directs the pressurized fluid to alternate ones of the chambers 54 and 58 through a control system 68 according to this invention.

The control system 68 includes a fluid conduit 70 extending from the outlet of the pump 63 to a stationary valve block 72. A schematically illustrated, solenoid operated arming valve 74 is disposed in the conduit 70 and has a first or open position, illustrated in the drawing, permitting free flow of fluid in the conduit 70 and a second or closed position, not shown, wherein flow in the conduit 70 is blocked except for possible leakage around the valve. When the solenoid is deenergized, the arming valve assumes and is retained in the closed position.

The control system 68 further includes a selector valve assembly 75 disposed in a main bore 76 in the valve block 72 aligned on an axis 78 of the latter. The main bore is sealingly closed at opposite ends by a pair of end caps 80 and 82 and includes a plurality of circumferential grooves 83*a*–83*e*. A cylindrical sleeve 84 in the main bore 76 is captured between the end caps and includes a plurality of outer circumferential grooves 85*a*–85*e*, a corresponding plurality of inner circumferential grooves 86*a*–86*e*, and a plurality of radial orifices 88*a*–88*e* between corresponding pairs of grooves 85*a*–85*e* and 86*a*–86*e*. The grooves 83*a*–83*e* in the main bore cooperate with respective ones of the outer grooves 85*a*–85*e* on the sleeve in defining a plurality of annular galleries 89*a*–89*e* which are sealingly separated by a plurality of seal rings 90 on the sleeve. Annular galleries 89*a* and 89*e* are connected to the sump 64 through a pair of schematically illustrated bores 91 and 92, respectively, in the valve block. The galleries 89*b* and 89*d* are connected, respectively, to the annular chambers 58 and 54 in the coupling 10 through passages 62 and 56 in the housing 12 and a pair of conduits 94 and 96, respectively, in the valve block. The annular gallery 89*c* is connected to the fluid conduit 70 by a passage 98 in the valve block 72.

The selector valve assembly 75 further includes a valve spool 100 having a plurality of circumferential lands 102*a* through 102*d* separated by a plurality of grooves 104*a* through 104*c*. The spool 100 is supported in the sleeve 84 for longitudinal movement in opposite directions along the axis 78 from a neutral position, shown in the drawing, leftward to a retract position and rightward to an extend position. The valve spool 100 cooperates with the end cap 80 in defining a first pilot chamber 106 and with the end cap 82 in defining a second pilot chamber 108. Respective ones of a pair of identical springs 110 are disposed in the pilot chambers 106 and 108 and maintain the valve spool 100 in the neutral or centered position.

The control system 68 further includes a pair of solenoid operated pilot valves 112 and 114 interconnected by a cross bore 116 in the valve block which also intersects passage 98. The pilot valve 112 has an exhaust passage 118 connected through appropriate passages in the block 72 to the sump 64 and a supply passage 120. A solenoid plunger assembly 122 of the pilot valve 112 has a normal off position wherein spring force or other means causes the plunger assembly to hold a bail element 124 against a seat whereby the ball element seals the corresponding end of the cross bore 116. In the off position of the plunger assembly, the supply passage 120 communicates with the exhaust passage 118 around the ball element. The plunger assembly 122 also has an on position, corresponding to energization of a winding 125 around the plunger assembly, wherein the latter is withdrawn from the ball element 124 a distance sufficient to permit fluid pressure in the cross bore 116 to reseat the ball element 124 against another seat severing communication between the supply passage 120 and the exhaust passage 118 and permitting pressure fluid to flow in front of the ball element from the cross bore 116 into the supply passage 120. Similarly, the pilot valve 114 includes an exhaust passage 126 in communication with the sump 64 through appropriate passages in the valve block 72, a supply passage 128, and a solenoid plunger assembly 130. The plunger assembly 130 has a normal off position wherein spring force or other means causes the plunger assembly to hold a ball element 132 against a seat whereby the ball element seals the corresponding end of cross bore 116. In the off position of the plunger assembly 130, the supply passage 128 communicates with the exhaust passage 126 around the ball element 132. The plunger 130 also has an on position, corresponding to energization of a winding 133 around the plunger assembly, wherein the latter is withdrawn from the ball element 132 a distance sufficient to permit pressure in the cross bore 116 to reseat the ball element against another seat severing communication between the supply passage 128 and the exhaust passage 126 and permitting pressure fluid to flow in front of the ball element from the cross bore 116 into the supply passage 128. The supply passage 120 in the pilot valve 112 is in fluid communication with the pilot chamber 106 through a passage 134 in the valve block 72. Similarly, the supply passage 128 in the pilot valve 114 is in fluid communication with the pilot chamber 108 through a passage 136 in the valve block 72. The annular gallery 89*d* is in fluid communication with the passage 134 through a branch passage 138. Similarly, the annular gallery 89*b* is in fluid communication with the passage 136 through a branch passage 140. The branch passages 138 and 140 should be small in cross-sectional flow area, or should include restricting orifices, to insure that substantially all pressure fluid flow in passages 134 and 136, respectively, is directed to the pilot chambers 106 and 108 when the ball elements 124 and 132 uncover corresponding ends of the cross bore 116.

In operation, the control system 68 functions normally to stroke the intermediate lock member 36 between the locked end unlocked positions thereof in response to dual control inputs to the selector valve assembly 75 and the arming valve 74. More particlarly, a first control input to the arming valve energizes the solenoid thereof to position the valve in the open position wherein pressure fluid fills passage 98, cross bore 116, annular gallery 89*c*, and groove 104*b*. With the valve spool 100 in the center or neutral position thereof, lands 102*b* and 102*c* of the valve spool block escape of pressure fluid from the groove 104*b*. Before the second control input to the selector valve assembly 75, each of the solenoid plunger assemblies 122 and 130 in the pilot valves 112 and 114 maintains the corresponding one of the ball elements 124 and 132 in seated position blocking opposite ends of the cross bore 116 so that no pressure fluid is admitted to the supply passages 120 and 128. Each of the chambers 54 and 58 in the coupling 10 is connected to the sump, respectively, via passages 56 and 62 in housing 12, conduits 96 and 94 in the valve block, grooves 104*c* and 104*a* in the valve spool 100, and bores 92 and 91 in the valve block. Parallel paths in the sump are established from galleries 89*d* and 89*b* in communication with conduits 96 and 94 through branch passages 138 and 140, passages 134 and 136, pilot valve supply passages 120 and 128, and pilot valve exhaust passages 118 and 126. The pilot chambers 106 and 108 are likewise exhausted through the pilot valves via passages 134 and 136. Accordingly, in the neutral position of the selector valve spool the annular chambers 54 and 58 in the coupling 10 are connected directly to the sump 64.

Assuming the intermediate lock member 36 is in the unlocked position thereof, the latter is stroked to the locked position by actuation of the selector valve spool 100 to the extend position. In particular, the solenoid winding 125 is energized to withdraw plunger assembly 122 in pilot valve 112 from ball element 124. Pressure in the cross bore 116 reseats the ball element 124 in a position isolating the exhaust passage 118 from the supply passage 120 so that fluid flows through the latter and through passage 134 to the pilot chamber 106 and through the branch passage 138 to the annular gallery 89*d*. Pressure in pilot chamber 106 shifts valve spool 100 rightward from the neutral position to the extend position wherein groove 104*b* in the valve spool spans the grooves 86*c* and 86*d* in the sleeve 84 so that pressure fluid is admitted to chamber 54 via passage 56 and conduit 96. Simultaneously, land 102*c* on the valve spool 100 isolates the bore 92 from conduit 96 while the conduit 94 is maintained in continuous communication with bore 91 via groove 104*a* in the valve spool. No fluid flows through branch passage 138 because fluid pressure in passage 134 at one end thereof is equal to fluid pressure in the annular gallery 89*d* at the other end thereof. Accordingly, the intermediate lock member 36 is stroked from the unlocked to the locked position. In stroking the intermediate lock member 36 from the locked position to the unlocked position, the selector valve spool is actuated to the left to the retract position thereof by energization of solenoid winding 133 in pilot valve 114. In that event, operation of the selector valve is as described hereinbefore except that passage 62 communicates with annular gallery 89*c* via groove 104*b* in the valve spool and conduit 94 while passage 56 is connected to the sump via bore 92 and conduit 96 in the valve block.

In an abnormal situation, as for example when arming valve 74 is in the closed position and the selector valve spool 100 is shifted from the neutral position to one or the other of the extend and retract positions, one of the chambers 54 and 58 in the coupling 10 is in communication with passage 98. In that situation, and over a prolonged period of time, fluid leakage around the arming valve migrates to one of the conduits 94 and 96 in communication with passage 98 thereby slowly filling the corresponding one of the annular chambers 58 and 54 in the coupling. Because, however, that corresponding one of the conduits 94 and 96 is also in communication with one of the branch passages 140 and 138, a path to the sump 64 is available for the leakage fluid. In particular, assuming the arming valve is in the closed position and each of the solenoid operated pilot valves 112 and 114 are off, if the valve spool 100 is, in some unintentional way, stroked to the extend position, fluid leakage from passage 98 into groove 104*b* of the valve spool migrates to the chamber 54 until the latter is filled whereupon continued flow of leakage fluid causes migration of the fluid through branch passage 138, passage 134, supply passage 120 of the pilot valve 112 and then around the ball element 124 held seated against the end of cross bore 116 by the plunger assembly 122 and into the exhaust passage 118 and the sump 64. Accordingly, no pressure buildup occurs in the annular chamber 54 so that the intermediate lock member 36 cannot be stroked to the locked position. In the same manner, with the arming valve closed and the valve spool 100, in some unintentional way, stroked to the retract position thereof, pressure buildup in the chamber 58 in the coupling 10 is avoided through exhaust of leakage fluid through the branch passage 140, passage 136, supply passage 128 in the pilot valve 114 and exhaust passage 126 in the latter.

The embodiments of the invention in which an exclusive property or privilege is claimed are defined as follows:

1. Between a pressure fluid operated actuator having an operating chamber and a source of pressure fluid, a control system comprising, an arming valve connected to said source having an open position and a closed position for respectively unblocking and blocking the flow of fluid from said source, a pilot operated selector valve connected to said arming valve having a neutral position and an extend position for respectively blocking and unblocking the flow of fluid from said arming valve, first conduit means between said selector valve and said actuator operating chamber operative to conduct fluid to said operating chamber in said open position of said arming valve and said extend position of said selector valve, a solenoid operated pilot valve connected to said source and to a fluid sump having an on position and an off position respectively unblocking and blocking the flow of fluid from said source, second conduit means between said pilot valve and a pilot chamber of said selector valve operative to conduct pressure fluid to said pilot chamber in said on position of said pilot valve whereby said selector valve is actuated to said extend position, said pilot valve in said closed position thereof connecting said second conduit means to said sump to permit return of said selector valve to said neutral position, and third conduit means between said first and said second conduit means operative to connect said actuator operating chamber to said sump whenever said pilot valve is in said closed position.

2. Between a pressure fluid operated actuator having a pair of operating chambers and a source of pressure fluid, a control system comprising, an arming valve connected to said source having an open position and a closed position for respectively unblocking and blocking the flow of fluid from said source, a pilot operated selector valve connected to said arming valve and to a sump having a neutral position blocking the flow of fluid from said arming valve and an extend open position and a retract position each unblocking the flow of fluid from said arming valve, a first supply conduit between said selector valve and a first of said pair of operating chambers of said actuator, a second supply conduit between said selector valve and a second of said pair of operating chambers of said actuator, said selector valve in said neutral position thereof connecting each of said first and said second supply conduits to said sump and in said extend position connecting said first supply conduit to said arming valve and said second supply conduit to said sump and in said retract position connecting said second supply conduit to said arming valve and said first supply conduit to said sump, a first solenoid operated pilot valve connected to said source and to said sump having an on position and an off position respectively unblocking and blocking the flow of fluid from said source, a second solenoid operated pilot valve connected to said source and to said sump having an on position and an off position respectively unblocking and blocking the flow of fluid from said source, a first pilot conduit between said first pilot valve and a first pilot chamber of said selector valve operative to conduct fluid to said first pilot chamber in said on position of said first pilot valve whereby said selector valve is actuated to said extend position, said first pilot valve in said off position thereof connecting said first pilot conduit to said sump to permit return of said selector valve to said neutral position, a second pilot conduit between said second pilot valve and a second pilot chamber of said selector valve operative to conduit fluid to said second pilot chamber in said on position of said second pilot valve whereby said selector valve is actuated to said retract position, said second pilot valve in said off position thereof connecting said second pilot conduit to said sump to permit return of said selector valve to said neutral position, a first branch conduit between said first supply conduit and said first pilot conduit operative to connect said first operating chamber to said sump whenever said first pilot valve is in said off position, and a second branch conduit between said second supply conduit and said second pilot conduit operative to connect said second operating chamber to said sump whenever said second pilot valve is in said off position.

* * * * *